US008292583B2

(12) United States Patent
Marra

(10) Patent No.: US 8,292,583 B2
(45) Date of Patent: Oct. 23, 2012

(54) TURBINE BLADE HAVING A CONSTANT THICKNESS AIRFOIL SKIN

(75) Inventor: John J. Marra, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 612 days.

(21) Appl. No.: 12/540,430

(22) Filed: Aug. 13, 2009

(65) Prior Publication Data

US 2011/0038734 A1 Feb. 17, 2011

(51) Int. Cl.
*F01D 5/08* (2006.01)

(52) U.S. Cl. ..... 416/97 R; 416/193 A; 416/224; 416/226; 416/500; 415/115; 415/119

(58) Field of Classification Search ..... 416/97 R, 416/193 A, 223 R, 224, 226, 243, 500; 415/115, 415/119

See application file for complete search history.

(56) References Cited

U.S. PATENT DOCUMENTS

| | | | | |
|---|---|---|---|---|
| 2,873,944 | A | 2/1959 | Wiese et al. | |
| 2,879,028 | A | 3/1959 | Stalker | |
| 2,920,866 | A | 1/1960 | Spurrier | |
| 3,240,468 | A | 3/1966 | Watts et al. | |
| 3,695,778 | A | 10/1972 | Taylor | |
| 4,501,053 | A * | 2/1985 | Craig et al. | 416/193 A |
| 4,604,780 | A | 8/1986 | Metcalfe | |
| 4,802,823 | A | 2/1989 | Decko et al. | |
| 5,609,779 | A * | 3/1997 | Crow et al. | 219/121.71 |
| 6,050,777 | A * | 4/2000 | Tabbita et al. | 416/97 R |
| 6,158,963 | A * | 12/2000 | Hollis et al. | 416/219 R |
| 6,247,896 | B1 * | 6/2001 | Auxier et al. | 416/97 R |
| 6,524,074 | B2 | 2/2003 | Farrar et al. | |
| 7,025,568 | B2 | 4/2006 | Jones | |
| 7,075,296 | B2 | 7/2006 | Moore | |
| 7,128,536 | B2 | 10/2006 | Williams et al. | |
| 7,311,500 | B2 | 12/2007 | Rongong et al. | |
| 2008/0253885 | A1 * | 10/2008 | Foose et al. | 415/208.2 |
| 2008/0286115 | A1 | 11/2008 | Liang | |

FOREIGN PATENT DOCUMENTS

GB 2272731 A 5/1994

OTHER PUBLICATIONS

W.D. MacDonald et al.; Transient Liquid Phase Bonding Processes; The Metal Science of Joining; 1992; pp. 93-100; The Minerals, Metals & Materials Society.

* cited by examiner

*Primary Examiner* — Igor Kershteyn

(57) ABSTRACT

A turbine blade is provided for a gas turbine comprising: a support structure comprising a base defining a root of the blade and a framework extending radially outwardly from the base, and an outer skin coupled to the support structure framework. The skin has a generally constant thickness along substantially the entire radial extent thereof. The framework and the skin define an airfoil of the blade.

20 Claims, 6 Drawing Sheets

TURBINE BLADE HAVING A CONSTANT THICKNESS AIRFOIL SKIN

This invention was made with U.S. Government support under Contract Number DE-FC26-05NT42644 awarded by the U.S. Department of Energy. The U.S. Government has certain rights to this invention.

FIELD OF THE INVENTION

The present invention relates to turbine blades for a gas turbine wherein the blades comprise a support structure and an outer airfoil skin having a generally constant thickness along a radial direction.

BACKGROUND OF THE INVENTION

Some turbine blades for use in gas turbines employ load-bearing airfoil sidewalls, in which a cumulative centrifugal loading of the blade is carried radially inwardly via the airfoil sidewalls. In such a design, the thicknesses of radially outermost portions of the airfoil sidewalls determine the thicknesses of radially innermost portions of the airfoil sidewalls near a root of the blade. As turbine blades become larger and the rotational speeds of the blades become greater, the thicknesses of the radially innermost portions of the airfoil sidewalls become so great as to render such blade designs infeasible.

SUMMARY OF THE INVENTION

In accordance with a first aspect of the present invention, a turbine blade is provided for a gas turbine comprising: a support structure comprising a base defining a root of the blade and a framework extending radially outwardly from the base, and an outer skin coupled to the support structure framework such that the skin does not transfer a substantial portion of cumulative blade centrifugal loads inwardly to the root. Preferably, the skin has a generally constant thickness along substantially the entire radial extent thereof. The framework and the skin define an airfoil of the blade.

The support structure framework may comprise a plurality of spars extending radially outwardly from the base and a plurality of stringers extending between the spars.

The support structure may further comprise a plurality of first tabs extending away from a leading spar and a plurality of second tabs extending away from a trailing spar. The skin may be coupled to the spars, the stringers and the first and second tabs.

Cooling openings may be provided in the spars and the stringers.

A tip cap may be coupled to the spars.

The turbine blade may further comprise a damping element extending through openings provided in the stringers. The damping element comprising at least one damping bulb making contact with and extending between opposing sections of the skin. The damping bulb damps vibrations in the skin.

The turbine blade may further comprise at least one platform section, non-integral with and located adjacent to the airfoil. The blade root may be mounted to a disk and the platform section may be coupled to the disk, such as by a bolt.

The skin may have a thickness falling within a range of from about 0.010 inch to about 0.040 inch.

A thickness of the support structure framework may become smaller in a radial direction from a first end adjacent the base to a second end opposite the first end.

In accordance with a second aspect of the present invention, a turbine blade is provided for a gas turbine comprising: a support structure comprising a base defining a root of the blade and a framework extending radially outwardly from the base; a skin coupled to the support structure framework, the framework and the skin defining an airfoil of the blade; and a damping element extending through openings provided in the support structure framework. The damping element may comprise a rod having at least one member making contact with and extending between opposing sections of the skin. The member may damp vibrations in the skin.

The at least one member may comprise at least one bulb.

In accordance with a third aspect of the present invention, a turbine blade is provided for a gas turbine mounted to a rotor disk comprising: a support structure comprising a base defining a curved root of the blade and a framework extending radially outwardly from the base; a skin coupled to the support structure framework, the framework and the skin defining a curved airfoil of the blade; and at least one curved platform section located adjacent to the airfoil and coupled to the rotor disk.

The blade root may be mounted to a disk and the platform section may be coupled to the disk.

The platform section may be bolted to the disk at one location on the platform and further coupled to the disk via a non-bolted mechanical connection at another location on the platform.

The at least one platform section may comprise first and second platform sections mounted on opposing sides of the airfoil.

The root, airfoil and platform may be curved in an axial and circumferential plane.

DETAILED DESCRIPTION OF THE INVENTION

Figure 10:
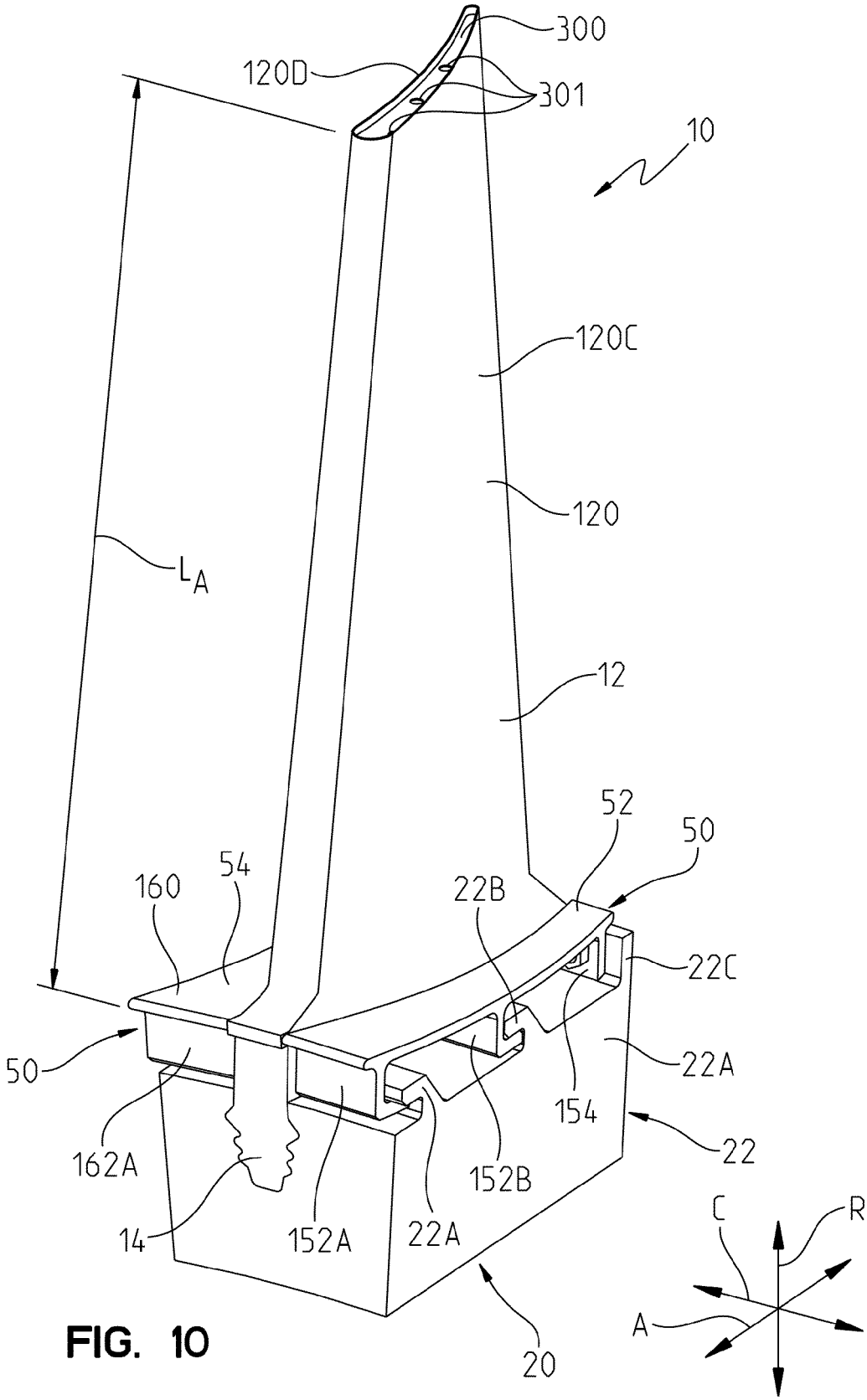
FIG. 10 is a perspective view of a turbine blade constructed in accordance with the present invention and, shown coupled to the disk of the shaft and disc assembly.

Referring now to FIG. 10, a blade 10 constructed in accordance with an embodiment of the present invention is illustrated. The blade 10 is adapted to be used in a gas turbine (not shown) of a gas turbine engine (not shown). Within the gas turbine are a series of rows of stationary vanes and rotating blades. Typically, there are four rows of blades in a gas turbine. It is contemplated that the blade 10 illustrated in FIG. 10 may define the blade configuration for a fourth row of blades in the gas turbine.

The turbine blades 10 are coupled to a shaft and disc assembly 20. A portion 22A of a disc 22 of the shaft and disc assembly 20 is illustrated in FIG. 10. Hot working gases from a combustor (not shown) in the gas turbine engine travel to the rows of blades. As the working gases expand through the gas turbine, the working gases cause the blades, and therefore the shaft and disc assembly 20, to rotate.

Each blade 10 forming the fourth row of blades may be constructed in the same manner as blade 10 discussed herein and illustrated in FIG. 10.

The turbine blade 10 is considered larger than a typical turbine blade as it comprises an airfoil 12 which may have a length $L_A$ of about 750 mm, see FIG. 10. The airfoil 12 may alternatively have other lengths. The blade 10 is also believed to be capable of rotating with the shaft and disc assembly 20 at a speed of up to about 3600 RPM. It is believed that the blade 10, due to its size and capability of being rotated at high speeds, improves the overall efficiency of the turbine in which it is used.

Figure 1:
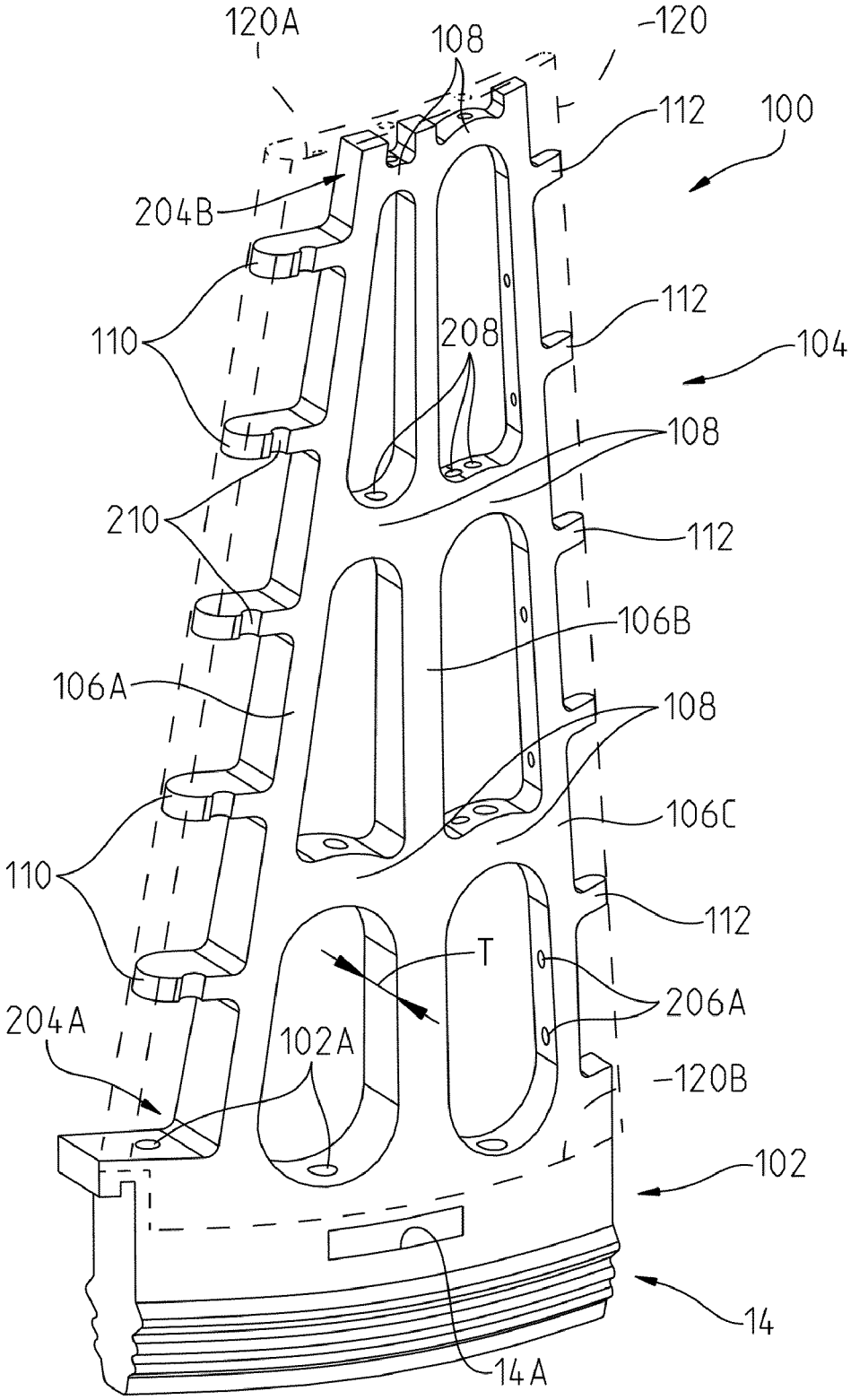
FIG. 1 is a perspective view of a curved support structure of a turbine blade of the present invention.
Figure 2:
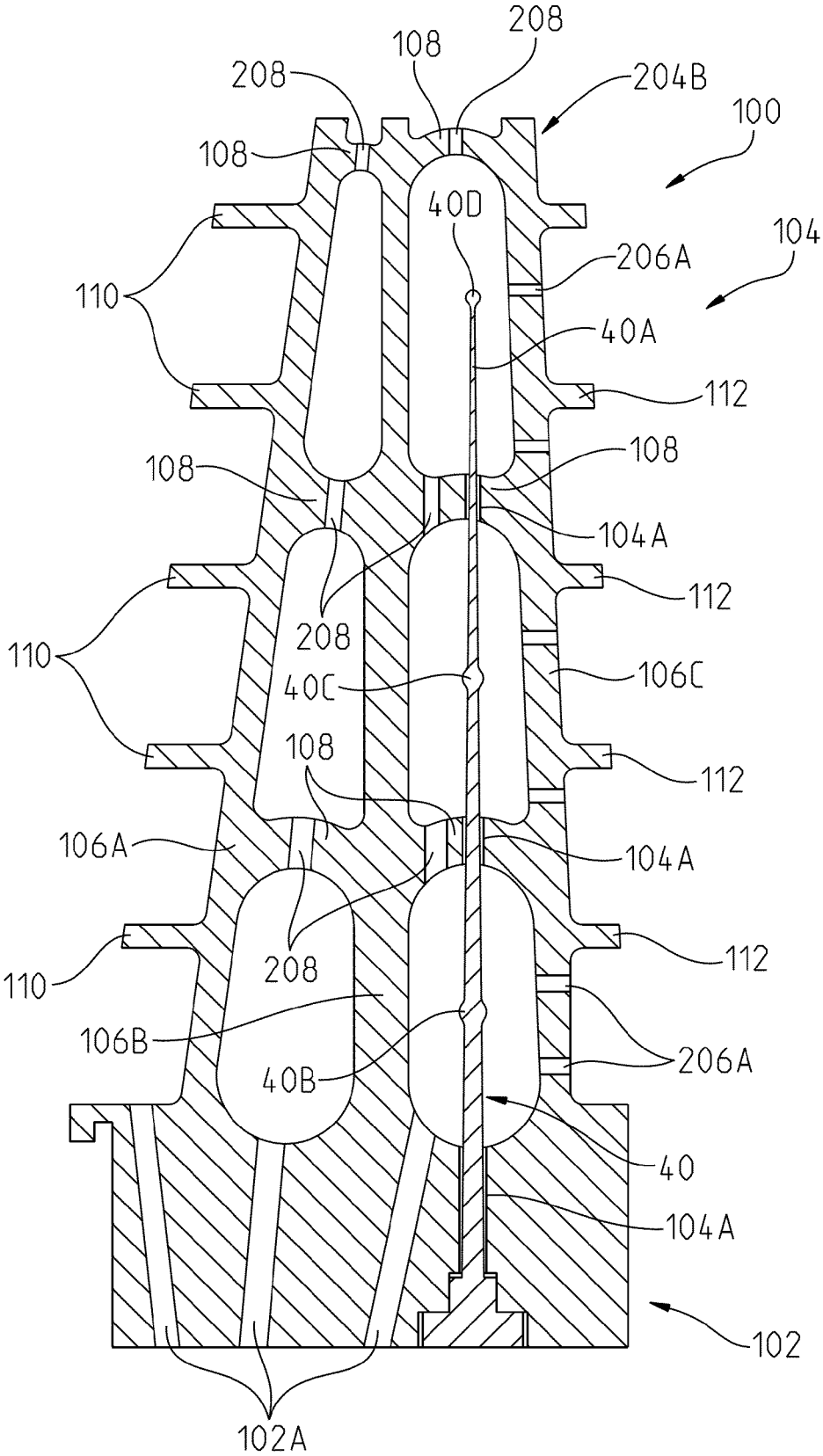
FIG. 2 is a cross sectional view of the support structure illustrated in FIG. 1.

The turbine blade 10 comprises a curved support structure 100 comprising a base 102 defining a curved root 14 of the blade 10 and a curved framework 104 extending radially outwardly from the base 102, see FIGS. 1 and 2. In the illustrated embodiment, the base 102 and framework 104 are integrally formed together via a casting process from a material such as a cast nickel alloy, one example of which is Inconel 738. The support structure 100 may also be formed via a powder metallurgy process using a nickel-based super alloy disk material, one example of which is Inconel 718. The support structure 100 may be plated with braze material, such as Ti—Cu—Ni.

The support structure framework 104 comprises, in the illustrated embodiment, leading, intermediate and trailing spars 106A-106C, respectfully, extending radially outwardly from the base 102 and a plurality of stringers 108 extending transversely between the spars 106A-106C. The support structure framework 104 further comprises a plurality of first tabs 110 extending away from the leading spar 106A and a plurality of second tabs 112 extending away from the trailing spar 106C. A thickness T of the support structure framework 104 may become smaller in a radial direction from a first end 204A adjacent the base 102 to a second upper end 204B, see FIG. 1.

The turbine blade 10 further comprises an outer skin 120 coupled to the support structure framework 104, wherein the skin 120 has an upper edge 120A and a lower edge 120B, see FIGS. 1 and 10. The outer skin 120 is preferably formed from a nickel super alloy such as Inconel 617 or Haynes 230, or an oxide dispersed nickel alloy such as MA 956. The outer skin 120 is also preferably cut from a sheet flat rolled to a minimum practical thickness falling with a range, such as from about 0.010 inch to about 0.040 inch.

Figure 5:
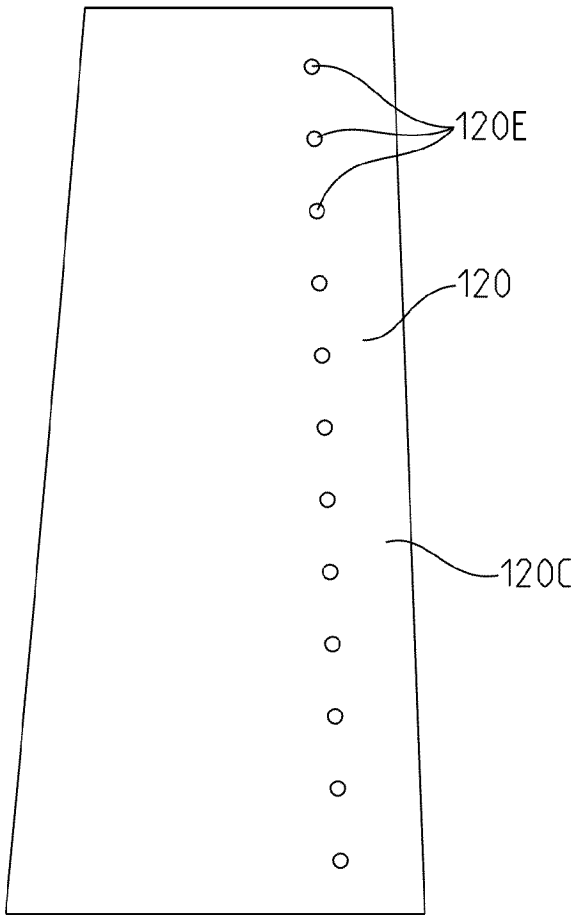
FIG. 5 is a plan view of a suction sidewall sheet or section of an outer skin of the turbine blade of the present invention.
Figure 4:
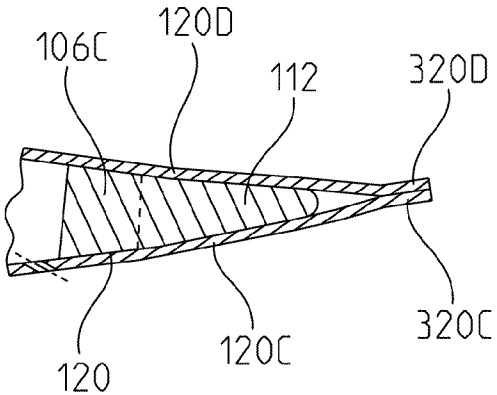
FIG. 4 is a cross sectional view through a trailing edge of the blade.
Figure 3:
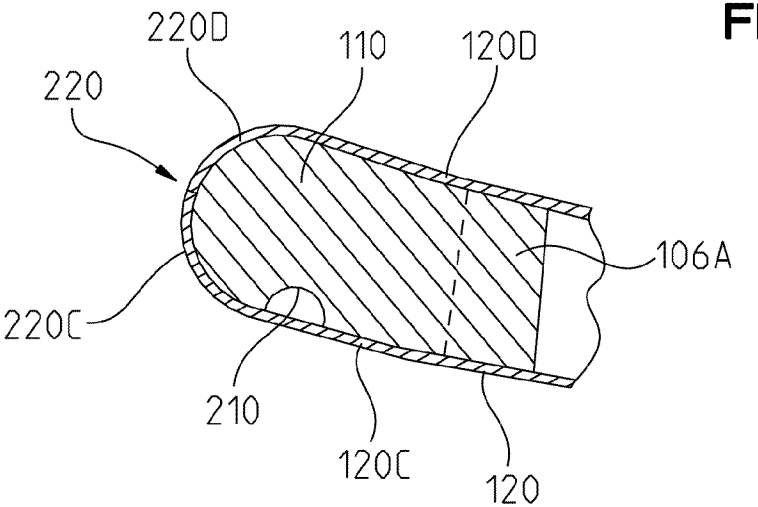
FIG. 3 is a cross sectional view through a leading edge of the blade.
Figure 6:
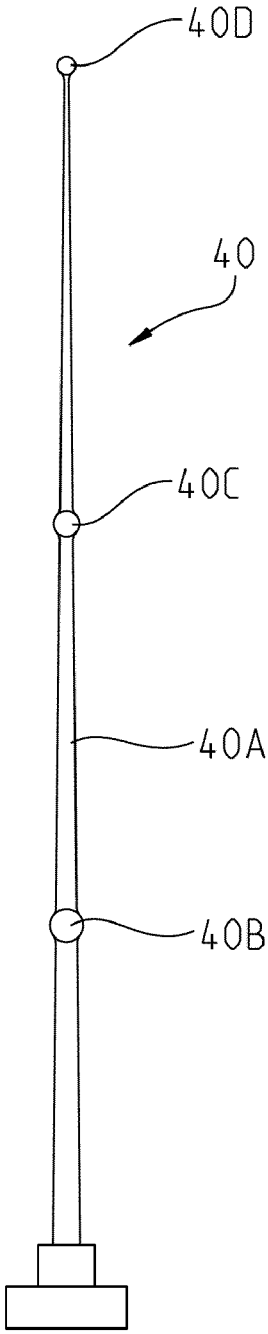
FIG. 6 is a front view of a damping element of the turbine blade of the present invention.

In the illustrated embodiment, the outer skin 120 comprises a suction sidewall sheet or section 120C and a pressure sidewall sheet or section 120D, see FIG. 10. In accordance with the present invention, the suction sidewall sheet 120C and the pressure sidewall sheet 120D are preferably cut from a sheet flat rolled to a minimum practical thickness falling with a range, such as from about 0.010 inch to about 0.040 inch. Cooling holes 120E are then laser cut or trepanned into the sheets 120C and 120, see FIG. 5. Next, the suction and pressure sidewall sheets 120C and 120D are hot formed via dies to a required shape defined by the support structure framework 104. Hence, the suction sidewall 120C has a convex shape and the pressure sidewall 120D has a concave shape. A leading edge portion 220C of the suction sheet 120C and a leading edge portion 220D of the pressure sheet 120D, see FIG. 3, are then electron beam welded along substantially the entire radial extent of the sheets 120C and 120D. The weld 220 is machined and inspected. The welded suction and pressure sheets 120C and 120D are then fitted over the support structure framework 104 and brazed to the support structure framework 104. Thereafter, a trailing edge portion 320C of the suction sheet 120C and a trailing edge portion 320D of the pressure sheet 120D, see FIG. 4, are brazed together along substantially the entire radial extent of the sheets 120C and 120D.

A tip cap 300 having cooling fluid holes 301 may be riveted and/or brazed to the upper end 204B of the support structure framework 104. The tip cap 300 is then brazed near the upper edge 120A of the outer skin 120 for outer skin vibration control.

The outer skin 120 is intended to transfer gas turning loads to the support structure framework 104, but is not intended to transfer cumulative centrifugal loads for the blade radially inward to the root 12. Rather, the framework 104 functions to carry the cumulative blade centrifugal loads radially inward to the root 12. Hence, the number and size of the framework spars, stringers and tabs may vary so as to accommodate the cumulative centrifugal loads for a given blade design. Because the outer skin 120 is not intended to transfer cumulative centrifugal loads radially inwardly, it is believed that the outer skin 120 can be made thinner and have a substantially constant thickness, such as along its entire extent in the radial direction.

First cooling openings 206A are provided in the trailing spar 106C, second cooling openings 208 are provided in the stringers 108 and cooling recesses 210 are provided in the first tabs 110, see FIGS. 1 and 2. Input cooling bores 102A are formed in the base 102. Hence, cooling fluid, such as air from the compressor of the gas turbine engine, is circulated internally within the blade 10 through the cooling bores 102A, the first and second cooling openings 206A and 208 and the cooling recesses 210 and exits the blade 10 via the cooling holes 120E in the outer skin 120 and the cooling holes 301 in the tip cap 300.

Figure 7:
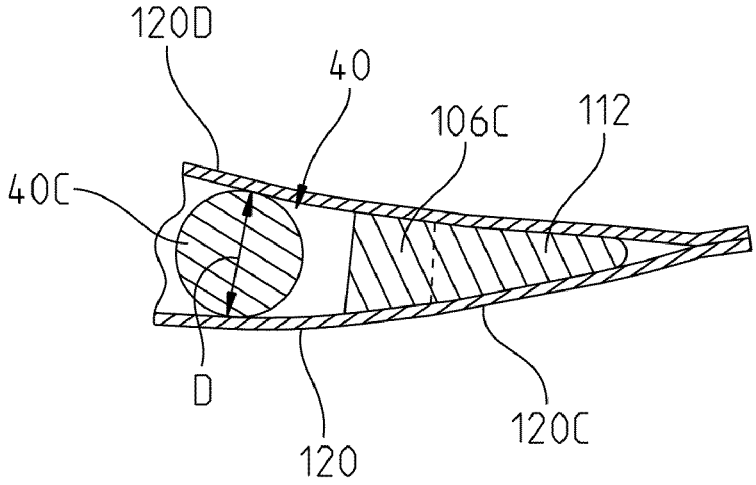
FIG. 7 is a cross sectional view of a trailing edge of the turbine blade taken through a damping element bulb.

The turbine blade 10 may further comprise a damping element 40 comprising a rod 40A and first, second and third members, such as first, second and third damping bulbs 40B-40D, integral with the rod 40A. The damping element 40 may be formed from a lathe-turned Nickel alloy. The damping element rod 40A and bulbs 40B-40D extend through openings 104A provided in the support structure framework 104. Each damping bulb 40B-40D has a thickness or diameter substantially equal to or slightly larger than a distance D between adjacent portions of the opposing suction sidewall section 120C and pressure sidewall section 120D so as to make contact with the sidewall sections 120C and 120D, see FIG. 7. The damping bulbs 40B-40D function to frictionally damp vibrations in the outer skin 120.

The turbine blade 10 further comprises a curved platform 50, which, in the illustrated embodiment, is non-integral with and located adjacent to the airfoil 12 and root 14. The platform 50 comprises first and second curved platform sections 52 and 54, respectively, coupled to the disk 22 of the shaft and disc assembly 20 on opposing sides of the airfoil 12, see FIG. 10. The blade root 14 is also mounted to the disk 22, see FIG. 10.

Figure 8:
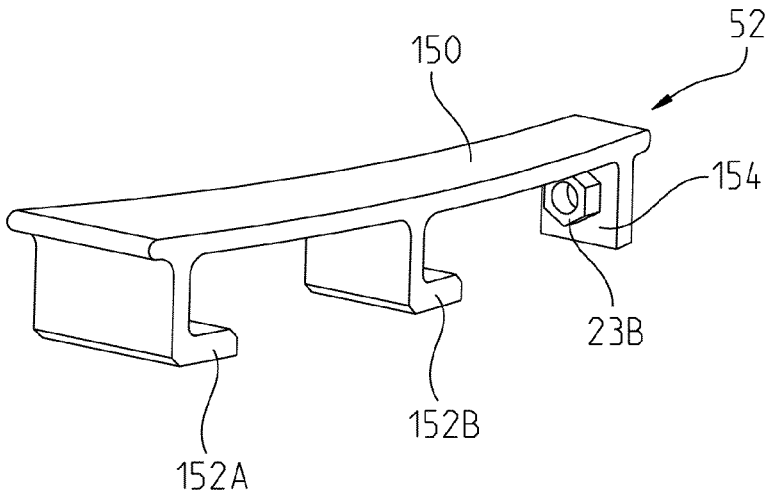
FIG. 8 is a perspective view of a curved platform section.
Figure 9:
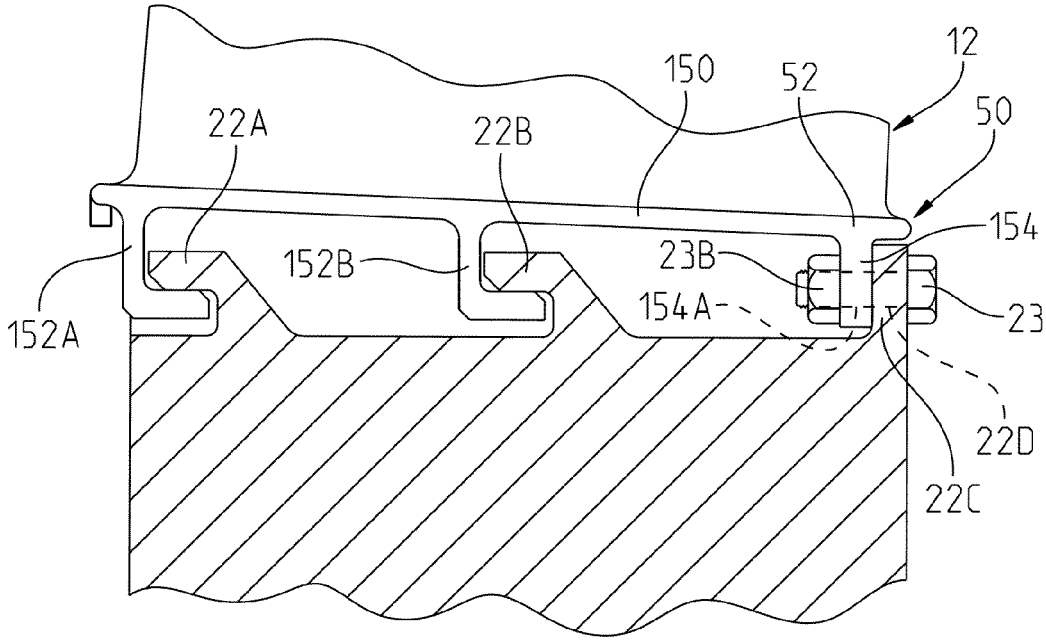
FIG. 9 is view of a portion of the turbine blade airfoil and illustrating the curved platform section of FIG. 8 coupled to a disk of a shaft and disc assembly.

The first curved platform section 52 comprises an upper section 150, first and second hooks 152A and 152B and a flange 154 provided with a bore 154A, see FIGS. 8-10. The disk 22 is provided with a first hook 22A that interlocks with the first platform section first hook 152A and a second hook 22B that interlocks with the first platform section second hook 152B. The disk further comprises a first flange 22C that comprises a bore 22D. The flange 154 on the first platform section 52 is positioned adjacent to the disk flange 22C. A bolt 23A passes through the bores 22D and 154A in the flanges 22C and 154 as well as through a nut 23B coupled to the flange 154A so as to couple the first platform section 52 to the disk 22.

The second curved platform section 54 comprises an upper section 160, first and second hooks 162A (only the first hook is shown in FIG. 10) and a flange (not shown) provided with a bore. The disk 22 is provided with a third hook (not shown) that interlocks with the second platform section first hook 162A and a fourth hook (not shown) that interlocks with the second platform section second hook. The disk 22 further comprises a second flange (not shown) that comprises a bore. The flange on the second platform section 54 is positioned adjacent to the disk second flange. A bolt (not shown) passes through the bores in the disk second flange and the flange on the second platform section 54 as well as through a nut (not shown) coupled to the flange on the second platform section 54 so as to coupled the second platform section 54 to the disk 22.

The root 14 is provided with a slot 14A that does not extend completely through the root 14. A damping seal pin may extend into the slot 14A so as to engage the root 14 and effect a frictional damping function.

The root 14, airfoil 12 and platform 50 may be curved in an axial and circumferential plane, wherein the axial direction is designated by axis A, the radial direction is designated by axis R and the circumferential direction is designated by axis C in FIG. 10.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine blade for a gas turbine comprising:

a support structure comprising a base defining a root of said blade and a framework extending radially outwardly from said base, said support structure framework comprising:

a plurality of spars extending radially outwardly from said base;

a plurality of first tabs extending away from a leading spar; and a plurality of second tabs extending away from a trailing spar, said skin being coupled to said spars and said first and second tabs; and an outer skin coupled to said support structure framework, said skin having a generally constant thickness along substantially the entire radial extent thereof, and said framework and said skin defining an airfoil of said blade.

2. The turbine blade as set out in claim 1, wherein said support structure framework further comprises a plurality of stringers extending between said spars.

3. The turbine blade as set out in claim 2, wherein cooling openings are provided in said spars and said stringers.

4. The turbine blade as set out in claim 1, further comprising a tip cap coupled to said spars.

5. The turbine blade as set out in claim 2, further comprising a damping element extending through openings provided in said stringers, said damping element comprising at least one damping bulb making contact with and extending between opposing sections of said skin, said damping bulb damping vibrations in said skin.

6. The turbine blade as set out in claim 1, further comprising at least one platform section, non-integral with and located adjacent to said airfoil.

7. The turbine blade as set out in claim 6, wherein said blade root is mounted to a disk and said platform section is coupled to the disk.

8. The turbine blade as set out in claim 1, wherein said skin has a thickness falling within a range of from about 0.010 inch to about 0.040 inch.

9. The turbine blade as set out in claim 1, wherein a thickness of said support structure framework becomes smaller in a radial direction from a first end adjacent said base to a second end opposite said first end.

10. A turbine blade for a gas turbine comprising:

a support structure comprising a base defining a root of said blade and a framework extending radially outwardly from said base;

a skin coupled to said support structure framework, said framework and said skin defining an airfoil of said blade; and a damping element extending through openings provided in said support structure framework, said damping element comprising a rod having at least one member making contact with and extending between opposing sections of said skin, said member damping vibrations in said skin.

11. The turbine blade as set out in claim 10, wherein said support structure framework comprises a plurality of spars extending radially outwardly from said base and a plurality of stringers extending between said spars, said openings being provided in said stringers.

12. The turbine blade as set out in claim 10, wherein said at least one member comprises at least one bulb.

13. The turbine blade as set out in claim 10, wherein a thickness of said support structure framework becomes smaller in a radial direction from a first end adjacent said base to a second end opposite said first end.

14. A turbine blade for a gas turbine mounted to a rotor disk comprising:

a support structure comprising a base defining a curved root of said blade and a framework extending radially outwardly from said base;

a skin coupled to said support structure framework, said framework and said skin defining a curved airfoil of said blade; and at least one curved platform section located adjacent to said airfoil and coupled to said rotor disk.

15. The turbine blade as set out in claim 14, wherein said blade root is mounted to said rotor disk.

16. The turbine blade as set out in claim 15, wherein said platform section is bolted to said rotor disk at one location on said platform and further coupled to said rotor disk via a non-bolted mechanical connection at another location on said platform.

17. The turbine blade as set out in claim 14, wherein said at least one platform section comprises first and second platform sections mounted on opposing sides of said airfoil.

18. The turbine blade as set out in claim 14, wherein said root, said airfoil, and said platform section are curved in an axial and circumferential plane.

19. The turbine blade as set out in claim 14, wherein said support structure framework comprises:

a plurality of spars extending radially outwardly from said base;

a plurality of first tabs extending away from a leading spar; and a plurality of second tabs extending away from a trailing spar, said skin being coupled to said spars and said first and second tabs.

20. The turbine blade as set out in claim 14, wherein said support structure framework comprises a plurality of stringers and a damping element extending through openings provided in said stringers, said damping element making contact with and extending between opposing sections of said skin, said damping element damping vibrations in said skin.

* * * * *